United States Patent [19]

Montgomery

[11] 4,078,606

[45] Mar. 14, 1978

[54] PRESSURE ACTUATED HOLDING APPARATUS

[75] Inventor: James W. Montgomery, Houston, Tex.

[73] Assignee: Brown Oil Tools, Inc., Houston, Tex.

[21] Appl. No.: 750,830

[22] Filed: Dec. 15, 1976

[51] Int. Cl.[2] ..... E21B 33/12

[52] U.S. Cl. ..... 166/120; 166/129; 166/138

[58] Field of Search ..... 166/133, 120, 188, 130, 166/129, 134, 138

[56] References Cited

U.S. PATENT DOCUMENTS

| | | | |
|---|---|---|---|
| 3,253,656 | 5/1966 | Brown | 166/129 |
| 3,294,172 | 12/1966 | Brown | 166/130 |
| 3,429,375 | 2/1969 | Craig | 166/130 |
| 3,659,647 | 5/1972 | Brown | 166/134 |

*Primary Examiner*—James A. Leppink
*Attorney, Agent, or Firm*—Browning, Bushman, & Zamecki

[57] ABSTRACT

Disclosed is pressure responsive holding apparatus for maintaining a first cylindrical element fixed against fluid pressure induced longitudinal movement relative to a second element generally circumscribing the first element. The apparatus includes a gripping device, carried by the first element, and reponsive to fluid pressure between the two elements by moving into anchoring engagement with the second element to hold the first element fixed relative to the second element with force which increases as the fluid pressure increases. In the embodiment shown, the holding apparatus is used to retain a bypass passage through a well packer set in a well conduit closed by preventing fluid pressure from raising a mandrel assembly within the packer body to open the bypass passage.

23 Claims, 9 Drawing Figures

PRESSURE ACTUATED HOLDING APPARATUS

BACKGROUND OF THE INVENTION

1. Field of the Invention

The present invention is related to pressure responsive holding devices. More particularly, the present invention pertains to pressure compensation apparatus for responding to fluid pressures, tending to dislodge a first element from engagement with a second element, whereby gripping means are actuated to anchor the first element relative to the second with force which increases as the pressure increases. Such pressure compensation apparatus find application in well tools where downhole fluid pressures tend to dislodge tool elements from a desired configuration.

2. Description of Prior Art

Well packers are used for a variety of purposes to seal one or more tubing strings, or other tubular bodies to a surrounding casing, or conduit, within a well. Generally, such a packer is positioned within the conduit, then set by manipulating the packer to expand sealing members, carried by the packer, into sealing engagement between the packer body and the conduit. Anchoring means, such as slips, are also made to engage the conduit in the set packer configuration to anchor the packer in place relative to the conduit, thereby preventing the sealing engagement of the sealing members with the conduit from being disturbed.

U.S. Pat. Nos. 3,279,542; 3,357,489; 3,467,184; and 3,659,647 as well as copending U.S. patent application Ser. No. 612,226, filed Sept. 10, 1975, now U.S. Pat. No. 4,018,274, issued Apr. 19, 1977 show setting and anchoring mechanisms which anchor the packer body to the well conduit with slips subject to wedging action from both vertical directions. Such dual wedging is advantageous for preventing fluid pressure in the well from unsetting the packer from either direction. An improvement in the setting of a weight set packer is disclosed in copending U.S. patent application Ser. No. 750,801, filed Dec. 15, 1976, assigned in part to the assignee of the present application, wherein the initialy set packer may be tightened in its set configuration. Such a feature provides the advantage of increased forces holding the packer in anchoring and sealing engagement with the surrounding conduit.

In the aforementioned patents and patent applications, with the exception of U.S. Pat. No. 3,659,647, a bypass passage is provided through the packer in addition to the primary flow passage provided within the tubing string which is extended through the packer. The bypass passage may be opened or closed by raising or lowering the tubing string to selectively permit or prevent fluid flow by the set packer along the annular region between the tubing string and the well conduit. While the aforementioned anchoring means are intended to hold the set packer body in place against the urging of well fluid pressure, the tubing string is subject to the same pressures, and adequate provision must be made to selectively maintain the tubing string in place to keep the bypass passage closed. To this end, pressure compensating devices may be provided for responding to pressure differentials across the set packer tending to move the tubing string longitudinally to open the bypass passage. The compensating devices thus react by increasing forces tending to hold the tubing string in place as the pressure differentials increase. An annular piston and split ring are used in U.S. patent application Ser. No. 612,226, filed Sept. 10, 1975, now U.S. Pat. No. 4,018,274, issued Apr. 19, 1 while a split locking ring and piston are shown in the second aforementioned copending U.S. patent application Ser. No. 750,801, filed Dec. 15, 1976. There, beveled surfaes of the locking ring and the annular piston cooperate to produce radially inward force components keeping the locking ring, held by the set packer body, in threaded engagement with a mandrel assembly attached to the tubing string to prevent longitudinal movement of the tubing string.

SUMMARY OF THE INVENTION

The apparatus of the present invention features a novel mechanism for holding a cylindrical element, such as a mandrel, fixed against longitudinal movement of the element relative to a second element generally circumscribing the mandrel. A gripping device, such as a split ring slip, is moveable between a first configuration, in which the gripping device anchors the two elements against mutual relative longitudinal movement, and a second configuration in which such anchoring is withdrawn to permit longitudinal movement of one element relative to the other.

The gripping device moves into the first, or anchoring configuration in response to fluid pressure in an area between the two elements. The fluid pressure acts upon a resilient pressure receiving device which propels the gripping device into the first configuration.

The gripping device and the pressure receiving device may be carried by either the first or the second element. On the first element, the gripping device may be a slip device in the form of an expandable split ring with gripping edges on its radially outer surface. The pressure receiving device, in the form of a generally annular expandable ring, is positioned radially inward of the split ring slip. The fluid pressure is directed to the radially inward side of the expandable ring, forcing the ring to expand and urge the slip radially outwardly against the second element.

When carried by the second element, the gripping device may be a slip device in the form of a generally compressible split ring with gripping edges on its radially inward surface. Then, the pressure receiving device, in the form of a generally compressible ring, receives the fluid pressure on its radially outward side to drive the slip radially inwardly against the first element. Whether the gripping device and the pressure receiving device are located on the first or the second element, the combination acts in response to fluid pressure communicated against the pressure receiving device from an area between the two elements to urge the gripping edges of the split ring slip against the opposite element to lock the two elements against mutual relative longitudinal motion.

Sealing means provide sealing engagement between the first and second elements to prevent the same fluid pressure, in response to which the gripping device acts to lock the two elements together, from neutralizing the effect of the fluid pressure acting on the pressure receiving device to allow the gripping device to return to its second, or non-anchoring, configuration. The seal means may take the form of one or more annular resilient seals cooperating with a seat device. When the seals are in fluid-sealing engagement with the seat, one or more paths, or passageways, communicate the fluid pressure in an area between the elements longitudinally to one side of the seals and seat to the pressure receiving device located, with the gripping device, to the longitudinally opposite side of the seals and seat. To bypass the seals, the path system may be carried by the first element along with the gripping device and the pressure receiving device. Similarly, when the gripping device and the pressure receiving device are carried by the second element, the path system may be located there also.

The seal means may be provided to maintain a fluid-tight seal between the two elements regardless of the longitudinal position of the first element relative to the second. The seal device may also be constructed to provide such sealing engagement between the two elements for only selected longitudinal positions of the first element relative to the second. In the embodiment described hereinafter, the seal device provides a fluid-tight seal between the two elements generally only for one longitudinal position of the first element relative to the second.

While it will be appreciated that the holding apparatus of the present invention may be applied generally to a combination of a first element generally circumscribed by a second element, particular application is found in the case of well tools. For example, and as described in detail hereinafter, the holding apparatus of the present invention may be employed to prevent a bypass flow passage through a packer set in a well casing from being forced open by downhole fluid pressures acting to urge the tubing string connected to the packer apparatus upwardly to open the bypass. In this case, the bypass flow passage extends between the body of the set packer, fluid-tight sealed to the surrounding well casing, and a mandrel assembly which passes generally through the packer body and is connected to a tubing string leading to the surface. When the tubing string and mandrel assembly are located in a particular longitudinal position relative to the set packer body, an annular seal cooperates with a seat member to close off the bypass. When the tubing string and mandrel are raised, the seat and seal combination is disengaged, and the bypass flow passage is open to allow fluid flow along the well casing and around the seals of the set packer body which engage the well casing.

The seal and seat combination which close off the bypass flow passage serve as the sealing device of the present invention. The gripping device, in the form of an expandable split ring slip, may be carried by the mandrel assembly with an appropriate expandable pressure receiving ring to the radially inward side of the slip. The path system may include an annular chamber, limited in part by the expandable ring, joined to one or more elongate paths positioned along the mandrel assembly to a point below where the bypass seal and seat members engage. There, the path system is opened to the region between the mandrel assembly and the set packer body to receive well fluid. Then, fluid pressure from below the set packer may be communicated along the path system upwardly beyond the bypass seal, sealingly engaged with the seat member, to the pressure receiving expandable ring. When the downhole fluid pressure increases, the effect on the expandable ring due to such increased pressure is to expand the ring, and urge the split ring slip outwardly against the packer body. As the fluid pressure increases, the force with which the slip presses against the packer body increases also. When the downhole fluid pressure is large enough to otherwise overcome the weight of the mandrel assembly and tubing string, so that, were it not for the split ring slip carried by the mandrel assembly being in anchoring engagement with the packer body, the mandrel assembly and tubing string would be lifted, the downhole fluid pressure itself acts to urge the slip against the packer body with sufficient force to lock the mandrel assembly and tubing string against longitudinal movement relative to the packer body, which is sealed and anchored to the surrounding well casing. Thus, the holding apparatus of the present invention acts as a pressure compensation means to utilize the fluid pressure tending to move the tubing string to actuate a slip device, which in turn acts to hold the tubing string against pressure induced longitudinal movement.

While it will be appreciated that the holding apparatus of the present invention may be employed with other well packers, the description of the invention provided hereinafter shows the present invention as part of a packer apparatus featuring the tightening mechanism described in the aforementioned copending U.S. patent application Ser. No. 750,801, filed Dec. 15, 1976, assigned in part to the assignee of the present invention. However, such application does not limit the present invention, and is provided for purposes of clarity of description only.

DESCRIPTION OF PREFERRED EMBODIMENTS

Figure 1A:
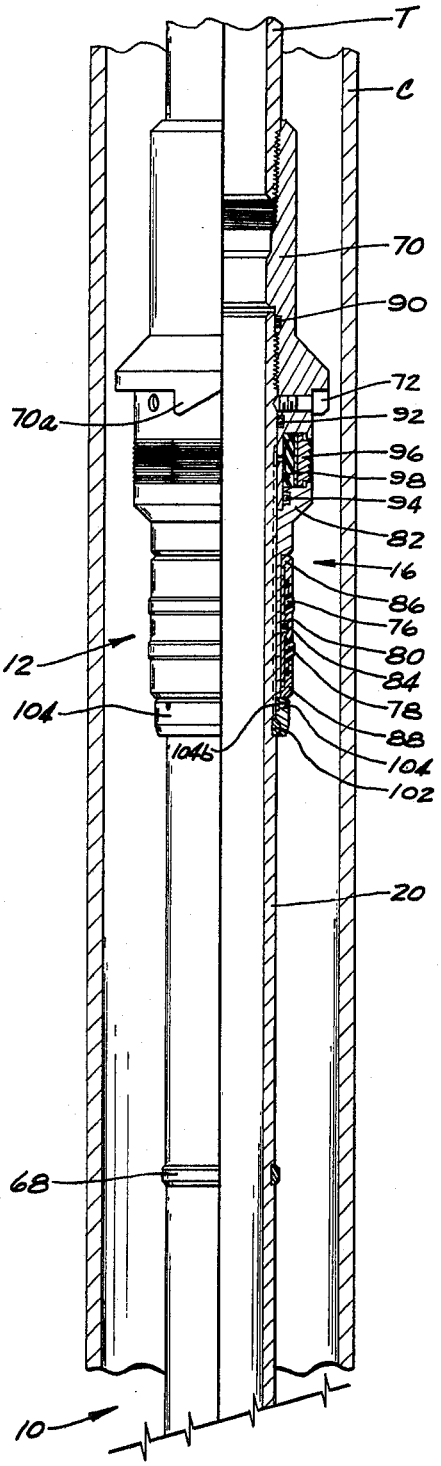
FIGS. 1A nd 1B together constitute a view, partially in vertical section and partially in elevation, illustrating a packer featuring the present invention in unset condition as it would appear while being lowered into position within a well casing, with FIG. 1A showing the mandrel extending above the packer body, and FIG. 1B showing the components of the packer body.
Figure 1B:
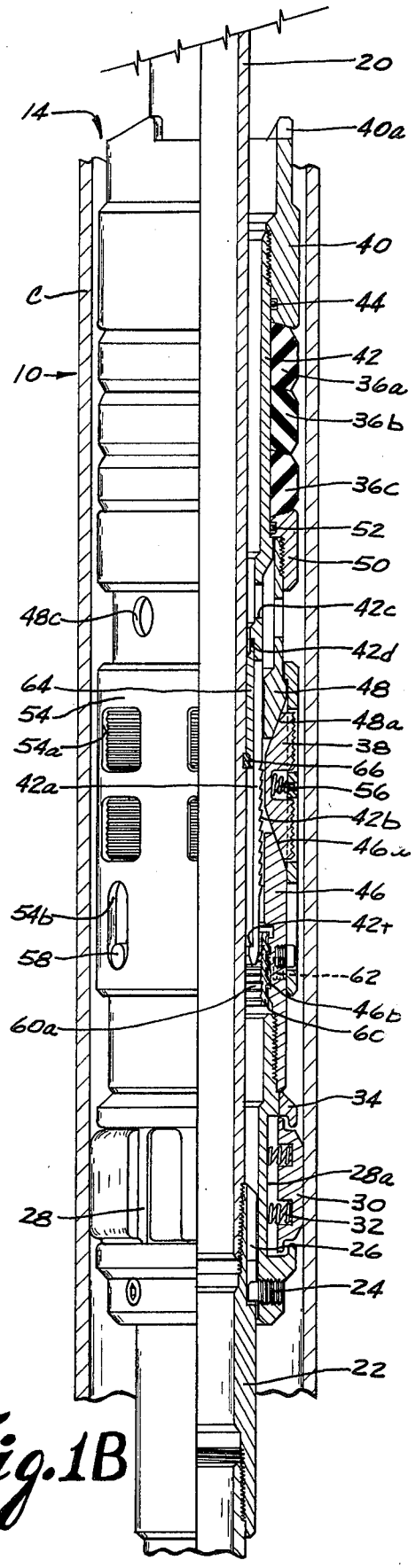

A well packer according to the present invention, indicated generally at 10, is illustrated in the drawings within a well casing, or conduit C. The packer is suspended within the casing C by a tubing string T which is threadedly engaged to the upper end of a mandrel assembly indicated generally at 12. The mandrel assembly 12 extends centrally through the packer body, which is indicated generally at 14. The mandrel assembly 12, which provides a tubular conduit, or primary flow passage, through the packer body 14, includes part of a pressure compensation mechanism indicated generally at 16 and described in detail hereinafter. The pressure compensation mechanism 16 is joined to a tubular mandrel body 20. As shown in FIGS. 1A and 1B, the packer body 14 is connected to the mandrel assembly 12 through the combination of a J-slot section 22, threadedly engaged, or otherwise rigidly secured, to the tubular mandrel body 20, and an array of J-slot pins 24 carried at the lower end of the packer body 14. In a conventional manner, each pin 24 extends into one of the J-slots 26 (best seen in FIGS. 2B and 3B) formed in the J-slot section 22. Each slot 26 includes a closed vertical leg **26*a* with upper and lower stops 26*b* and 26*c*, respectively, a slanted cam portion 26*d*, a vertical passage 26*e*, and a diverging mouth 26*f*. A continuation of the tubing string T' extends downwardly, as needed, from the J-slot section 22**.

A friction drag assembly 28 employs a plurality of spring loaded friction blocks 30 to hold the packer body 14 in frictional engagement with the internal wall of the casing C for a purpose to be described hereinafter. Each friction block 30 is allowed limited radial movement within an annular bay **28*a* of the friction drag assembly 28, and is urged outwardly by springs 32. A friction block retainer ring 34, welded to the friction drag assembly 28, further defines the top of the bay 28*a* to limit motion by the friction blocks 30**.

Figure 2A:
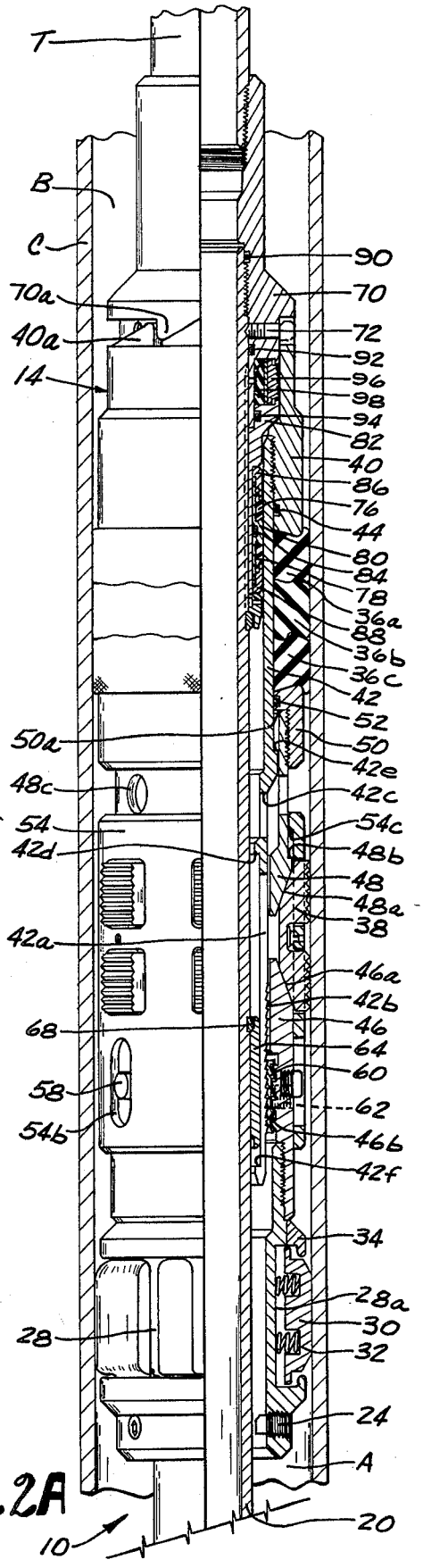
FIGS. 2A and 2B together constitute a view, similar to FIGS. 1A and 1B together, illustrating the packer in set condition with the bypass closed, FIG. 2A including the packer body, and FIG. 2B showing the mandrel extending below the packer body.

The packer body 14 includes resilient packer seals **36*a*, 36*b*, and 36*c*, and metal anchoring slip segments 38. When the packer 10 is set, as illustrated in FIG. 2A, the seals 36 function to form a fluid seal with the surrounding casing wall C, and the slip segments 38 are extended radially outwardly into firm gripping engagement with the surrounding casing wall. When the packer 10 is being moved relative to the casing C, the selas 36 and the slip segments 38** are radially retracted away from such engagement with the well casing, as illustrated in FIG. 1B.

The packer 10 is set by moving upper, or first, and lower, or second, components of the packer body 14 toward each other to compress the seals 36 and extend the slip segments 38. The first component includes an upper seal retainer 40 and a seal mount assembly 42. These two members 40 and 42 are threaded together in the illustrated manner so that they move as a unit. An O-ring 44 fluid seals the upper seal retainer 40 to the seal mount assembly 42.

The second, or lower, component includes a lower spreader cone 46 and the friction drag assembly 28. These latter two elements 46 and 28 are threaded together to move as a unit also. The lower spreader cone 46 cooperates, to maneuver the slip segments 38, with an upper spreader cone 48, which in turn is connected to a lower seal retainer 50. An O-ring 52 provided a fluid-tight sliding seal between the lower seal retainer 50 and the seal mount assembly 42. The lower spreader cone 46 has an upwardly facing beveled surface **46*a* at its upper end, while the upper spreader cone 48 has a downwardly facing beveled surface 48*a* at its lower end. The upper spreader cone 48 has a radially outwardly extending annular shoulder 48*b*, and the lower seal retainer 50 features a radially inwardly extending annular shoulder 50*a***, whose functions are described hereinafter.

The beveled surfaces **46*a* and 48*a* of the lower and upper spreader cones 46 and 48, respectively, and the anchoring slip segments 38 are disposed within a tubular slip cage 54. The gripping surfaces of the slip segments 38 extend through windows 54*a* in the slip cage 54. Each of the plurality of anchoring slip segments 38 features a pair of beveled surfaces, directed generally radially inwardly to ride on the spreader cone surfaces 46*a* and 48*a*. Springs 56, positioned between the slip cage 54 and the slip segments 38, bias the slip segments toward a radially retracted position out of engagement with the surrounding casing C. During the setting operation, the upper and lower spreader cones 46 and 48 are moved toward each other to wedge the slip segments 38 outwardly, overcoming this biasing force, and extending the slip segments into anchoring position. Pins 58 extend from the lower spreader cone 46 into slots 54*b* in the slip cage 54 to permit limited relative longitudinal displacement between the slip cage and the lower spreader cone as required during the setting operation while preventing relative rotational movement between the lower spreader cone and the slip cage. Similarly, as the two packer components are telescoped to a mating configuration, the seals 36 are compressed between the upper seal retainer 40 of the first packer component and the lower seal retainer 50, which is joined to the upper spreader cone 48. The slip cage 54 also features a radially inwardly extending annular shoulder 54*c***, whose function is described hereinafter.

The inner surface of the lower spreader cone 46 is threaded at **46*b*. A split ring locking slip 60 is threaded into place within the lower spreader cone 46. As best seen in FIG. 1B, the inner surface of the locking slip 60 is lined with buttress threads 60*a*, facing downwardly. The split in the locking slip 60 allows the locking slip a degree of flexibility, as discussed in more detail hereinafter. A set screw 62 is threaded in place in an appropriate hole in the lowr spreader cone 46, and passes through a hole in the locking slip 60 to prevent further rotation of the locking slip about the threads 46*b*. The seal mount assembly 42 extends downwardly within the tubular slip cage 54 in the form of collet fingers 42*a*. Each collet finger 42*a* is lined on its radially outer surface with buttress thread segments, or wedges, 42*b* facing upwardly. When the packer 10 is being run in the well conduit, or casing, C, the first and second components of the well packer are separated as shown in FIG. 1B. Then, the collet fingers wedges 42*b* are displaced longitudinally relative to the buttress threads 60*a* of the locking slip 60. During the setting operation, as the first and second components are telescoped toward each other, the collet fingers 42*a* pass downwardly within the locking slip 60, and the collet finger wedges 42*b* mesh with the buttress threads 60*a* of the locking slip, as illustrated in FIG. 2A. The seal mount assembly 42 is thus connected to the lower spreader cone 46 through the locking slip 60**. In this way, the first packer component is mated with the second packer component when the packer is in the set configuration.

The seal mount assembly 42 also features ports **42*c*, a radially inwardly extending annular shoulder 42*d*, and a radially outwardly extending annular shoulder 42*e***, whose functions are described hereinafter.

The collet fingers **42*a* are resilient, and may be moved radially. As shown in FIG. 2A, when the packer 10 is set, a locking sleeve 64 is moved radially inwardly of the collet fingers 42*a* opposite the locking slip 60 to prevent the collet fingers from moving inwardly and to ensure that the collet finger wedges 42*b* are maintained in a firm gripping mesh with the buttress threads 60*a* of the locking slip. Radially inwardly directed shoulders 42*f* at the bottom of the collet fingers 42*a* prevent the locking sleeve 64 from moving downwardly beyond the ends of the collet fingers. As will hereinafter be more fully explained, longitudinal, non-rotative lowering movement of the tubing string T and the attached mandrel assembly 12 moves the locking sleeve 64 under the collet fingers 42***a* and locking slip 60 during the setting procedure. Similar upward movement of the tubing string T and the mandrel assembly 12 removes the locking sleeve 64 from such position, into the position illustrated in FIG. 1B, when the packer 10 is being released from the set position. For this latter purpose, a lower split ring 66 carried on the tubular mandrel body 20 is adapted to engage the lower end of the locking sleeve 64 to pull the sleeve upwardly with upward movement of the mandrel assembly 12 during the releasing and retrieval operation. An upper split ring 68 carried on the tubular mandrel body 20 is adapted to engage the upper end of the locking sleeve 64 during the setting operation to lower the sleeve behind the collet fingers 42*a* and the locking slip 60.

During the setting procedure, the weight of the tubing string T is brought to bear on the upper packer component as the tubing string and the mandrel assembly 12 are lowered relative to the packer body 14. A clutch ring 70 forms the top section of the mandrel assembly 12, and is threaded directly to the tubing string T. The tubular mandrel body 20 is threaded to the clutch ring 70, and fixed against further rotational motion relative to the clutch ring by set screws 72. The clutch ring 70 is lowered into contact with the upper seal retainer 40 of the upper packer component. At the same time, the friction drag assembly 28 is acting to prevent downward longitudinal movement of the lower packer component relative to the well casing C. In this way, the weight of the tubing string T is employed to mate the upper and lower packer components by engagement of the collet finger wedges 42*b* with the buttress threads 60*a* of the locking slip 60. When this mating configuration is achieved, the slip segments 38 and the seals 36 are extended into engagement with the casing C. With the packer 10 thus initially set, additional force is generated to enhance the engagement of the seals 36 and the slip members 38 with the wall of the well casing C. Downwardly extending teeth 70*a* on the bottom of the clutch ring 70 mesh with an equal number of upwardly extending teeth 40*a* at the top of the upper seal retainer 40. The vertical faces of meshed tooth pairs 70*a* and 40*a* are oriented for transmission of torque in a right-hand rotational sense as illustrated. Once the upper and lower packer components are mated as described hereinbefore, application of torque to the tubing string T at the well surface causes rotation of the mandrel assembly 12 in a right-hand sense, with consequent rotation of the upper seal retainer 40. The two elements 40 and 42 comprising the first packer component then rotate as a unit relative to the second packer component which is held, by the friction drag assembly 28, rotationally fixed relative to the well casing C. The relative rotational motion between the two packer components results in the collet finger wedges 42*b* advancing downwardly relative to the buttress threads 60*a* of the locking slip 60. Such threading movement of the collet fingers 42*a* relative to the locking slip 60 results in continued mutual telescoping motion of the first and second packer components. Thus, as the tubing string T is used to rotate the first packer component relative to the second packer component through the torque-transmitting connection between the clutch ring 70 and the upper seal retainer 40, the upper and lower cone spreaders 48 and 46 further drive the slip segments 38 against the wall of the well casing C, and the upper and lower seal retainders 40 and 50 further longitudinally compress the seals 36, causing the seals to be further pressed against the wall of the casing.

Figure 3A:
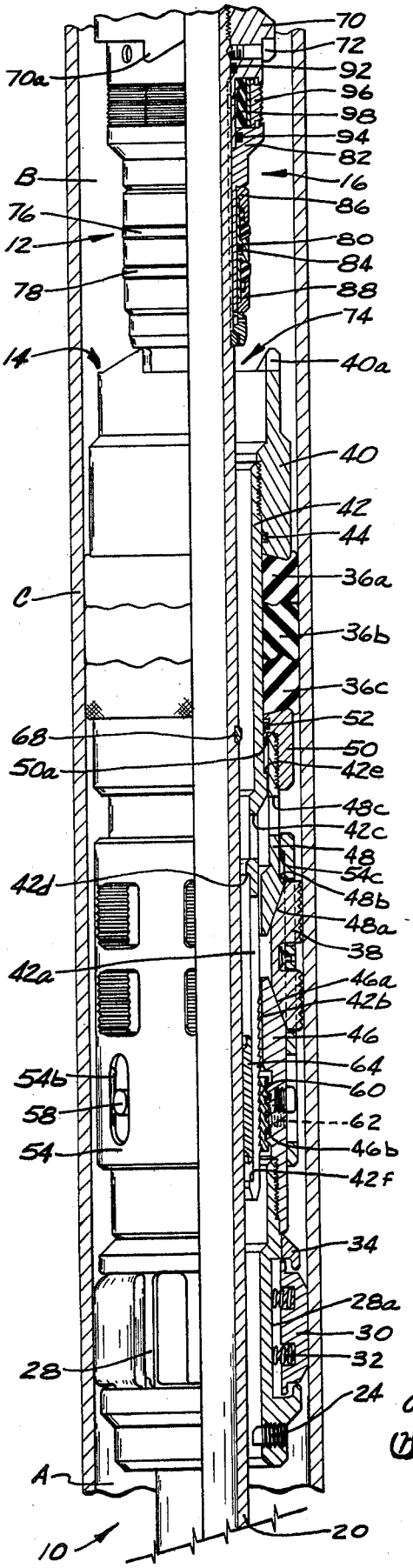
FIGS. 3A and 3B together constitute a view, similar to FIGS. 1A, 1B and 2A, 2B, illustrating the packer in set position with the bypass opened, FIG. 3A showing the packer body, and FIG. 3B showing the mandrel extending below the packer body.

FIG. 3A illustrates the packer in set condition, but with the mandrel assembly 12 elevated to open an annular bypass flow passage 74 which extends longitudinally between the mandrel assembly and the packer body 14. The flow passage 74 is closed when the tubing string T and the attached mandrel assembly 12 are lowered into the position illustrated in FIG. 2A. In this latter position, annular bypass seals 76 and 78, carried by the mandrel assembly 12, engage the inner surface of the seal mount assembly 42 carried by the packer body 14. The seal mount assembly 42 is thus an annular seat member for fluid-tight engagement with the bypass seals 76 and 78. The bypass seals 76 and 78 are mounted on a seal separator member 80, which in turn is mounted on a slip retainer sleeve 82. An O-ring 84 fluid-seals the seal separator member 80 to the slip retainer sleeve 82. The upper seal 76 extends under the downwardly facing lip of an upper seal retaining ring 86. Similarly, the lower seal 78 extends under the upwardly facing lip of a lower seal retaining ring 88. The upper retaining ring 86 cooperates with the seal separator member 80 to secure the upper seal 76 while that seal is able to maintain a sliding seal engagement with the upper seal retainer 40. Similarly, the lower seal 78 is held by the lower retaining ring 88 in cooperation with the seal separator member 80, and is also able to engage in sliding seal contact with the upper seal retainer 40. O-rings 90 and 92 fluid seal the clutch ring 70 to the tubular mandrel body 20, and an O-ring 94 fluid-seals and clutch mandrel body 20, and an O-ring 94 fluid-seals the clutch ring to the slip retainer sleeve 82.

When the secondary flow passage, or bypass, 74 through the set packer 10 is open, as illustrated in FIG. 3A, fluids in the annular region between the mandrel assembly 12 and the well casing C may flow into or out of the bypass 74 through the ports 42*c*, which extend through the seal mount assembly 42, and ports 48*c* which extend through the upper cone spreader 48. When the tubing string T and the mandrel assembly 12 are lowered into the position illustrated in FIG. 2A the annular bypass seals 76 and 78 engage the seat formed by the inner surface of the seal mount assembly 42 to close the bypass flow passage 74, as described hereinbefore. Then, O-rings 44, 52, 84, 90, 92 and 94 cooperate with the annular bypass seals 76 and 78 as well as the seals 36 to provide fluid tight sealing between the mandrel assembly 12 and the well casing C. Under normal procuding conditions, the pressure existing in the closed bypass 74 and the annulus area A below the set seals 36 is greater than the pressure existing in the annular area B above the packer 10. Under these circumstances, a pressure differential exists across the seals 76 and 78 which exerts an upward lifting force on the tubing string T and the attached mandrel assembly 12. To prevent this lifting force from opening the bypass 74, a pressure-responsive compensating system is employed to increase the forces maintaining the tubing string T and mandrel assembly 12 in position to close the bypass 74.

Figure 4:
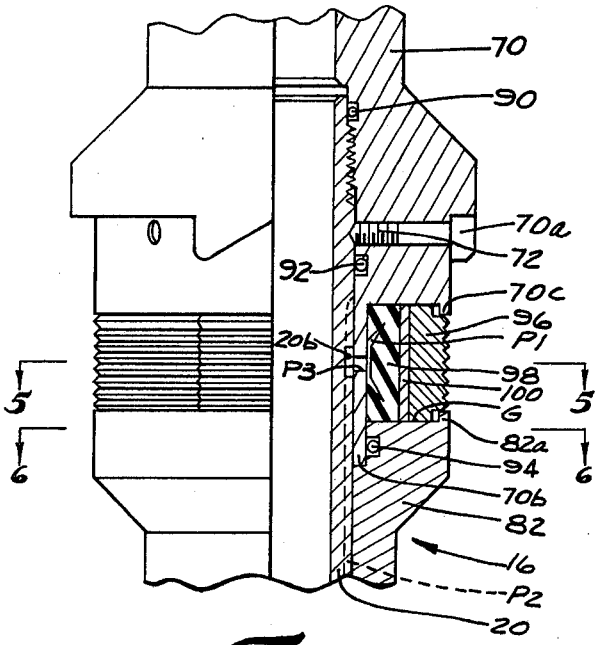
FIG. 4 is an enlarged scale, quarter sectional view of a fragment of the mandrel assembly, including the slip and pressure-receiving ring of the present invention.

The pressure compensation system of the present invention operates in response to pressure differentials across the set packer seals 36 and the seated bypass seals 76 and 78 to hold the mandrel assembly 12 and the tubing string T against longitudinal movement relative to the set packer body 14 and the well casing C with force which increases as the pressure differentials increase. The upper end of the tubular mandrel body 20 fits within the clutch ring 70, which features a downwardly-extending sleeve portion 70*b* as best seen in FIG. 4. A slip device, in the form of a split ring slip 96 with gripping edges on its radially outward surface, is held in an annular groove G formed by the clutch ring 70 in cooperation with the slip retainer sleeve 82. The groove G thus formed prevents axial movement of the split ring slip 96 relative to the mandrel assembly 12 while lips 70*c* and 82*a* of the clutch ring 70 and slip retainer sleeve 82, respectively, limit relative lateral displacement of the split ring slip.

Figure 5:
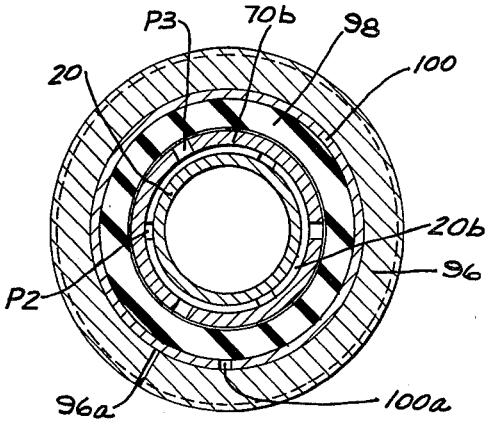
FIG. 5 is an enlarged scale, horizontal cross-sectional view taken along the line 5—5 of FIG. 4.

A resilient pressure-receiving device, in the form of an expandable ring 98, is also confined within the groove G, and is positioned radially between the clutch ring sleeve 70*b* and the split ring slip 96. A split lining sleeve 100 provides an interface between the expandable ring 98 and the split ring slip 98. As best seen in FIG. 5, the split ring slip 96 is split at 96*a*, and the lining sleeve 100 is split at 100*a*. These splits 96*a* and 100*a* allow the corresponding rings 96 and 100, respectively, to expand radially outwardly as fluid pressure acts on the radially inward side of the expandable ring to urge the three elements 96, 96 and 100 radially outwardly.

In the process of contructing the mandrel assembly 12, the expandable ring 98, the lining sleeve 100 and the split ring slip 96 may be positioned on the clutch ring sleeve portion 70*b*. A snap ring 102 is placed on the tubular mandrel body 20, and forms a lower stop for a collar 104. The bypass seals 76 and 78, held by the seal separator member 80, and the upper and lower seal retaining rings 86 and 88, respectively, are mounted on the slip retainer sleeve 82 with the O-ring 84 in place. The slip retainer sleeve 82 is positioned on the tubular mandrel body 20 against the collar 104, and, with the O-rings 90, 92, and 94 in place, the tubular mandrel body 20 is threaded to the clutch ring 70.

Figure 6:
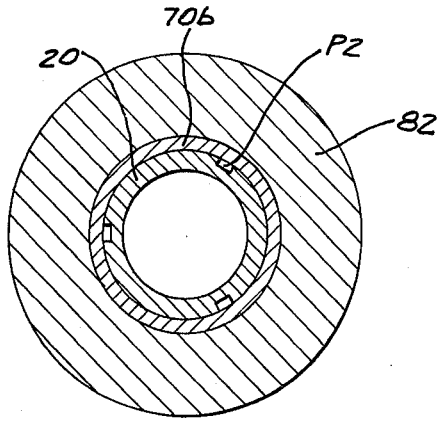
FIG. 6 is an enlarged scale, horizontal cross-section view taken along the line 6—6 of FIG. 4.

A path system is constructed within the tubular mandrel body 20, the collar 104, and the clutch ring 70 to communicate fluid pressure from below the bypass seals 76 and 78 to the pressure-receiving expandable ring 98 above the bypass seals. As best seen in FIG. 4, the radially inward side of the expandable ring 98 is shaped to form, in cooperation with the clutch sleeve portion 70*b*, a generally annular first passage P1 as part of the path system. Depending on the shape of the expandable ring 98, the first passage P1 may be collapsed when no fluid pressure is present to deform the expandable ring 98. A second passage P2 extends longitudinally along the tubular mandrel body 20 in the form of grooves cut therein, and covered by the clutch ring sleeve portion 70*b* and the slip retainer sleeve 82. While only one such groove may be provided for the second passage P2, the embodiment shown herein features three grooves, as seen in FIGS. 5 and 6. A third passage P3 includes radialthrough bores in the clutch ring sleeve portion 70*b* to communicate between the first and second passages P1 and P2, respectively. Although one such throughbore may be used for the third passage P3, three are shown in FIG. 5. An annular groove 20*b* in the tubular mandrel body 20 insures communiction between the second passage P2 grooves and the third passage P3 throughbores. As seen in FIG. 1A, one or more radial throughbores 104*a* and an annular groove 104*b* in the collar 104 provide communication between the second passage P2 and the region outside the mandrel assembly 12.

When the packer 10 is set, and the bypass flow passage 74 is closed as illustrated in FIG. 2A, pressure from below the seals 36 generates upwardly-directed forces on the mandrel assembly 12 and the tubing string T over an annular extending from the O-ring 90 outwardly to the seals 76 and 78, in fluid-tight sealing engagement with the seal mount assembly 42. This fluid pressure is communicated by the path system, from the radial throughbores 104*a* and annular groove 104*b* in the collar 104, along the second passage P2 to the third passage P3, and finally to the first passage P1, to act on the expandable ring 98. As seen in FIG. 4, the radially inward surface of the expandable ring 98 is shaped to form an annular pocket as fluid pressure acting thereon pushes the expandable ring generally radially outwardly. As the expandable ring 98 is thus deformed, a fluid-tight seal is maintained between the expandable ring 98 and the clutch ring 70 and the slip retainer sleeve 82. O-rings 92 and 94 also maintain the path system fluid-tight. Thus, the pressure differential due to the greater value of fluid pressure in the annulus region A compared to fluid pressure in the annulus region B is communicated along the path system to the pressure-receiving expandable ring 98, which, in turn, propels the split ring 96 radially outwardly into anchoring engagement with the upper seal retainer 40. With the packer 10 set, the packer body 14, including the upper seal retainer 40, is anchored to the well casing C. Thus, as the aforementioned pressure differential increases, the force with which the split ring slip is urged against the upper seal retainer 40 by action of the expandable ring 98 and the lining sleeve 100, responding to the pressure differential, increases also. In this way, the forces tending to raise the mandrel assembly 12 and the connected tubing string T, to open the bypass flow passage 74, are countered by increased forces locking the mandrel assembly to the set packer body 14.

When the pressure differential is reduced, by a change in condition in the well fluids such as a drop in pressure in the annulus region A, or by the pressure in the annulus region B being raised by pumping from the surface, or by some other factor, the pressure differential across the packer seals 36 and the bypass seals 76 and 78 is neutralized, and the split ring slip 96 is permitted to retract from anchoring engagement with the upper seal retainer 40 of the packer body 14. Then, the bypass flow passage 74 may be opened by raising the tubing string T and the attached mandrel assembly 12 to unseat the bypass seals 76 and 78 from sealing engagement with the seal mount assembly 42. Also, additional raising of the tubing string T, as described hereinafter, is permitted to retrieve the packer apparatus 10.

PLACING AND SETTING THE PACKER

The packer 10, connected to the tubing string T through the pins 24, is lowered into the well casing C with the packer elements in the relative positions illustrated in FIGS. 1A and 1B. In this running-in configuration, the friction blocks 30 slide along the internal surface of the casing C, resisting the sliding motion. The frictional forces exerted by the drag assembly 28 may be overcome by the weight of the tubing string T exerted against the pins 24 through the upper stops 26*b* of the J-slots 26.

When the desired subsurface location has been reached, the downward motion of the tubing string T is stopped and the tubing string is raised slightly until the pins 24 are engaged by the lower stops 26*c* of the respective J-slots 26. During this raising movement, the packer body 14 is held stationary within the casing C by the action of the friction drag assembly 28. With the pins 24 at the lower stops 26c, the tubing string T is slightly rotated, causing the pins to ride up the slanted cam portions 26d along the bottoms of the vertical passages of 26e of the J-slots 26, so that subsequent lowering of the tubing string T causes the pins to move into vertical passages. In this position, the tubing string T may be further lowered to clear the pins 24 out of the diverging slot mouths 26f and to continue the setting operation.

Continued lowering of the tubing string T permits the lower end of the clutch ring 70 to engage the top surface of the upper seal retainer 40. As these two elements approach each other, the teeth 70a of the clutch ring 70 mesh with the teeth 40a of the upper seal retainer 40. Subsequent lowering of the tubing string T exerts a downwardly directed force against the upper, or first, packer component, which causes the seal mount assembly 42 to telescope downward through the lower, or second, packer component which is held stationary by the friction drag assembly 28. This telescoping action causes the collet fingers 42a to move downwardly relative to the locking slip 60 and the lower spreader cone 46. During the initial phase of the setting movement, the upper seal retainer 40 is forced downwardly against the seals 36, which in turn urge the lower seal retainer 50 downwardly against the upper cone spreader 48. As this motion takes place, the lower spreader cone 46 is held fixed relative to the well casing C by the friction drag assembly 28. As a result, the slip segments 38 are urged downwardly over the lower spreader cone beveled surface 46a as the beveled surface 48a of the upper spreader cone 48 is wedged down behind the slip segments. The slip segments 38 are thus caused to move outwardly as they advance downwardly along the lower spreader cone 46. Once the slip segments 38 grip the casing C, very large downwardly directed forces may be exerted against the packer body 14 without displacing the packer. Continued lowering of the upper packer component further compresses the seals 36 into engagement with the wall casing C.

As the mandrel assembly 12 is lowered during this setting operation, the upper split ring 68 engages the upper end of the locking sleeve 64, causing the sleeve to move downwardly from the position illustrated in FIG. 1B to the position illustrated in FIG. 2A. In this latter position, the locking sleeve 64 holds the collet fingers 42a rigidly against the locking slip 60. Because of this function, the locking sleeve 64 in the position shown in FIG. 2A acts as a blocking means to block unlocking movement of the collet fingers 42a relative to the locking slip 60.

With the upper and lower packer components mated, and the packer initially set as described, the connection between the upper and lower packer components may be tightened by rotation of the tubing string T. Such rotation results in torque applied to the upper packer components through the meshed teeth 70a of the clutch ring 70 and 40a of the upper seal retainer 40. As the upper packer component is thus rotated in a right-hand sense relative to the well casing C, the lower packer component is held rotationally fixed to the well casing by the friction drag assembly 28 and/or the slip segments 38. As such relative rotational motion is carried out, the collet fingers 42a rotate relative to the locking slip 60, thereby causing the collet finger wedges 42b to advance along the helical buttress threads 60a lining the interior surface of the locking slip. Thus, the locking slip 60 is urged upwardly as the collet fingers 42a are drawn downwardly. The resulting effect is that the upper and lower packer components are further telescoped together, increasing the forces which wedge the slip segments 38 radially outwardly against the well casing C as well as the forces which press the seals 36 against the well casing in fluid-seal engagement.

Figure 2B:
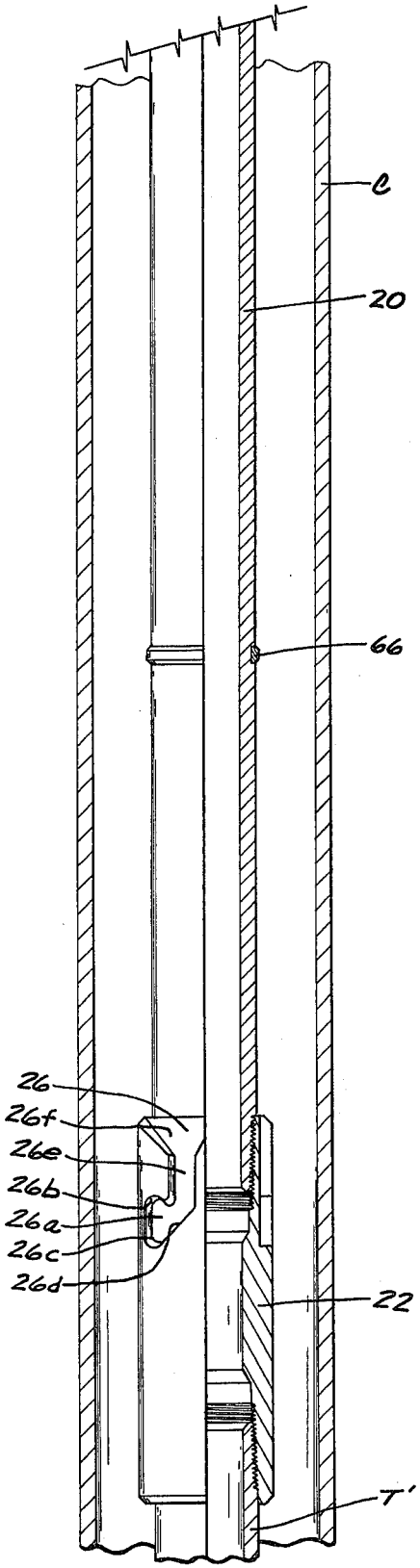
Figure 3B:
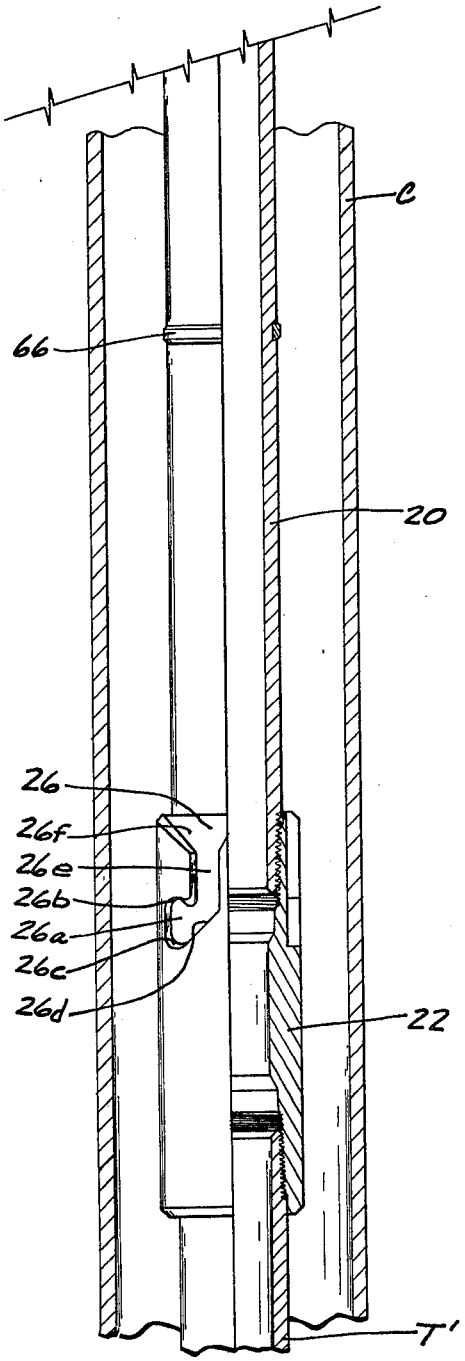

With the packer 10 thus tightened in its set configuration, as illustrated in FIGS. 2A and 2B, the well packer is firmly anchored against well pressures acting against the packer in either direction. Thus, if the pressure in the lower annular area A is greater than that in the upper annular area B, a net upwardly directed force is exerted against the packer seals 36. This force is imparted to the upper packer component which in turn acts through the collet fingers 42a and the locking slip 60 to cause the lower spreader cone 46 to exert additional force against the slip segments 38, which in turn increases the anchoring force by which the packer is held fixed to the well casing C. This force increases as the pressure differential increases. If the pressure above the packer in the annular area B is greater than that in the annular area A below the packer, a net downwardly directed force is exerted on the packer seals 36. This force acts against the lower seal retainer 50, which is rigidly connected to the upper spreader cone 48. Thus, increased downward forces on the seals 36 further urge the upper spreader cone 48 downwardly against the slip segments 38, so that once again the slip segments exert increasing anchoring forces against the well casing C as the pressure induced forces acting on the packer 10 increase.

The same pressure differentials which act across the packer seals 36 also act across the bypass seals 76 and 78 when the bypass 74 is closed. With a higher pressure below the seals 74 and 76, the pressure differential tends to raise the mandrel assembly 12 to unseat the bypass seals. As discussed in detail hereinbefore, increased gripping forces tending to hold the mandrel assembly 12 in position are generated by that same pressure differential through the mechanism of the split ring slip 96 gripping the upper seal retainer 40. If a reversal of the direction of the pressure differential occurs, such that the pressure above the set packer body 14 is higher than that below the packer body, the mandrel assembly 12 is urged downwardly against the packer body. In this case, the bypass seals 76 and 78 retain sealing engagement with the seal mount assembly 42, and the bypass flow passage 24 remains closed.

OPENING AND CLOSING THE BYPASS

The secondary bypass flow passage 74 may be opened by lifting the tubing string T to remove the annular bypass seals 76 and 78 from sealing engagement with the seal mount assembly 42, as shown in FIG. 3A. The tubing string T and the attached mandrel assembly 12 may be thus elevated to open the bypass 74, without disturbing the set condition of the packer body 14, to the point that the lower split ring 66 first engages the lower end of the locking sleeve 64. Since the upper and lower components of the packer body 14 are mated together through the locking slip 60 and the collet fingers 42a, the packer body 14 remains in set condition while the mandrel assembly 12 is elevated to open the bypass 74. As a result, well fluids may be circulated downwardly through the tubing string T, the mandrel assembly 12, and the tubing string continuation T', and up through the annular region A and the flow passage 74 at a rapid rate without concern for either unsetting or moving the packer.

Since the packer 10 remains set independently of the presence or absence of the weight of the tubing string T on the packer body 14, only enough tubing string weight need be set on the packer to close the bypass 74 so that the annular sliding seals 76 and 78 make sufficient contact with the seal mount assembly 42 to insure a fluid tight sealing closure of the bypass 74. This permits a very large portion of the tubing string weight to be carried by the well head so that the tubing string T can be stretched out to assume as linear a configuration as possible. This in turn facilitates wireline operations and similar servicing which must be performed through the tubing string T. Moreover, additional latitude in the design and construction of the packer 10 is permitted since the packer need not withstand the usual tubing string weight load required in maintaining some prior art weight set packers anchored during production.

OPERATION OF THE PRESSURE COMPENSATION APPARATUS

With the packer 10 set in the well casing C, and the secondary bypass flow passage 74 in the closed configuration with the annular bypass seals 76 and 78 seated against the seal mount assembly 42, the split ring slip 96 is in position to be propelled into gripping engagement with the upper seal retainer 40. Thus, when the fluid pressures in the well are such that a fluid pressure differential exists tending to lift the mandrel assembly 12 and the connected tubing string T relative to the set packer body 14, fluid pressure is communicated from below the bypass seals 76 and 78 along the path system to the radially inward side of the resilient expandable ring 98. As the pressure differential increases, the expandable ring 98 is deformed radially outwardly, pressing the lining sleeve 100 against the split ring slip 96. Thus, the split ring slip 96 is urged radially outwardly, in response to the fluid pressure differential, into gripping engagement with the upper seal retainer 40. The force with which the split ring slip 96 grips the upper seal retainer 40 increases as the pressure differential increases. In this way, the split ring slip 96 is propelled into an anchoring configuration, and maintained in that configuration by the pressure differential, to prevent longitudinal movement of the mandrel assembly 12 and the connected tubing string T relative to the set packer body 14 and the well casing C. The mandrel assembly 12 and the connected tubing string T are released for such lingitudinal movement relative to the well casing C when the pressure maintaining the split ring slip 96 in gripping engagement with the upper seal retainer 40 is decreased, or the pressure differential is otherwise effectively neutralized, so that the split ring slip 96 is permitted to return to its original, non-deformed, non-anchoring configuration.

RELEASING AND RETRIEVING THE PACKER

The packer 10 is released from its set position and retrieved to the surface, or repositioned for subsequent resetting in the casing C, by raising the tubing string T. This action draws the lower split ring 66 upwardly against the locking sleeve 64, and slides the locking sleeve upwardly within the collect fingers 42*a* out of locking position, as shown in FIGS. 2A and 3A, to the position illustrated in FIG. 1B. With the locking sleeve 64 thus positioned, the collect fingers 42*a* are free to bend radially inwardly permitting the collect finger wedges 42*b* to be raised and ratchet out of intermeshed gripping engagement with locking slip buttress threads 60*a* as the tubing string T is raised. The lifting force of the mandrel assembly 12 is transmitted through the split ring 66 and the locking sleeve 64 to the seal mount assembly 42 as the locking sleeve contacts the radially inward annular shoulder 42*d* of the seal mount assembly. The seal mount assembly 42 in turn transmits the lifting force to the upper spreader cone 48 by interaction of the radially outward shoulder 42*e* of the seal mount assembly and the radially inward shoulder 50*a* of the lower seal retainer 50, which is rigidly connected to the upper cone spreader. Thus, the entire upper packer component is raised, drawing the upper spreader cone 48 away from the slip segments 38. Continued upward lifting causes the upper spreader cone 48 to raise the slip cage 54 by interaction of the radially outward shoulder 48*b* with the radially inward shoulder 54*c* of the slip cage assembly. Upward movement of the slip cage assembly 54 pushes the anchoring slip segments 38 off of the lower spreader cone 46. This action allows the upper and lower components of the packer body 14 to return to their original, unmated positions, permitting the packer seals 36*a*, 36*b*, and 36*c* and the anchoring slip segments 38 to return to their retracted, unset positions.

Following retraction of the packer slip segments 38 and the seals 36, subsequent upward movement of the tubing string T draws the J-slot section 22 into engagement with the pins 24, each pin entering the diverging mouth 26*f* of a J-slot 26. As the tubing string T is further raised, the pins 24 align with the vertical passages 26*e*, and eventually the slanted cam portions 26*d* are drawn into engagement with the pins. Subsequent raising seats the pins 24 against the lower stops 26*c*, and the friction drag assembly 28 and the attached packer body 14 are lifted upwardly with the tubing string T.

It will be appreciated that the configuration of the packer 10, upon release from set configuration, is essentially the same as the configuration for running the packer in the well before setting. Thus, as seen in FIGS. 1A and 1B, weight of the packer body 14 is supported by the tubing string T through the mandrel assembly 12, the tubular mandrel body 20, the lower split ring 66, the locking sleeve 64, and the seal mount assembly 40. The seal mount assembly 64 supports the upper packer component directly, and the lower packer component through the lower seal retainer 50, the upper cone spreader 48, and the slip cage 54.

The packer 10 may be moved to a lower position within the well casing C by merely lowering the tubing string T. The previously described setting procedure may be repeated to anchor the packer 10 at any location in the well without need for retrieving the packer to the well surface.

From the foregoing description, it will be appreciated that: (a) the packer showing the present invention may be both set and released by longitudinal movement of the tubing string or other member for which is is suspended; (b) the packer may be tightened in the set configuration by rotational motion of the tubing string without need for additional weight or hydraulic pressure; (c) a bypass passage in the packer may be opened and closed by longitudinal, non-rotative movement of the tubing string while the packer remains firmly anchored in set configuration; (d) mechanical anchoring means automatically function to retain the packer firmly set against a high pressure acting on the packer from either above or below; and (e) pressure compensation means prevent the bypass passage from opening in response to pressure differentials across the packer.

The holding apparatus of the present invention has been described in a preferred embodiment of a well packer apparatus. Various changes in the construction and operation of the apparatus may be made without departing from the spirit of the invention. For example, bypass seals in the packer embodiment may be carried by the packer body, while the mandrel assembly provides an appropriate seating member. Also, a gripping device with appropriate resilient pressure-receiving means may be carried by the packer body to be compressed in response to the aforementioned pressure differentials so that the gripping device closes radially around the mandrel assembly to provide the anchoring engagement which increases in gripping force as the pressure differentials increase to prevent the mandrel assembly 12 and the connected tubing string T from rising relative to the set packer body 14 and the well casing C. Then, the path system which communicates the fluid pressure from below the bypass seals to the resilient pressure-receiving means may be carried as part of the packer body. Rather than expanding in response to fluid pressure received thereon, the resilient pressure-receiving means is driven radially inwardly by the fluid pressure acting thereon, to propel, and maintain in gripping engagement, the gripping device in the form, for example, of a split ring slip with gripping edges on its radially inward side. An appropriate split lining sleeve may also be provided as an interface between the pressure-receiving device and the split ring slip. Other variations in the present invention will be apparent, in view of the present disclosure, and lie within the scope of the present invention.

The foregoing disclosure and description of the invention is illustrative and explanatory thereof, and various changes in the details of the illustrated apparatus may be made within the scope of the appended claims without departing from the spirit of the invention.

I claim:

1. Apparatus for holding a first cylindrical element and a second cylindrical element, generally circumscribing said first element, against mutual relative longitudinal movement, comprising:

(a) seal means for effecting fluid-sealing between said first and second elements;

(b) gripping means, located longitudinally to one side of said seal means, and moveable between a first configuration, in which said gripping means provides anchoring engagement between said first and second elements to prevent relative longitudinal movement between said first and second elements, and a second configuration in which said gripping means is withdrawn from said anchoring engagement to permit relative longitudinal movement between said first and second elements;

(c) resilient pressure receiving means operable, when said seal means is effecting said fluid-sealing between said first and second elements, in response to fluid pressure acting on said pressure receiving means for propelling said gripping means into said first configuration, and maintaining said gripping means in said first configuration such that said gripping means is propelled into, and maintained in, said anchoring engagement with force which increases as said fluid pressure increases; and (d) path means for transmitting fluid pressure to said pressure receiving means from an area between said first and second element which area is located longitudinally to the opposite side of said seal means from said gripping means.

2. Apparatus as defined in claim 1 wherein said gripping means and said pressure receiving means are carried by said first element, said pressure receiving means comprises a generally annular expandable ring means located generally radially inward of said gripping means, and said expandable ring means is expandable generally radially outwardly in response to fluid pressure acting on said pressure receiving means to urge said gripping means generally radially outwardly into said first configuration.

3. Apparatus as defined in claim 2 wherein said gripping means comprises split ring slip means.

4. Apparatus as defined in claim 3 wherein said path means comprises:

(a) generally annular first passage means communicating with said pressure receiving means; and (b) second passage means, extending generally longitudinally and communicating said first passage means with said open area between said first and second elements.

5. Apparatus as defined in claim 4 wherein said path means further comprises third passage means extending generally radially for communicating between said first and second passage means.

6. Apparatus as defined in claim 6 wherein said seal means effects said fluid-sealing between said first and second elements when said first element is in a first longitudinal position relative to said second element, but said fluid-sealing is not effected by said seal means when said first element is in a second longitudinal position relative to said second element.

7. Apparatus as defined in claim 2 wherein said seal means effects said fluid-sealing between said first and second elements when said first element is in a first longitudinal position relative to said second element, but said fluid-sealing is not effected by said seal means when said first element is in a second longitudinal position relative to said second element.

8. Apparatus as defined in claim 1 wherein said seal means effects said fluid-sealing between said first and second elements when said first element is in a first longitudinal position relative to said second element, but said fluid-sealing is not effected by said seal means when said first element is in a second longitudinal position relative to said second element.

9. Apparatus as defined in claim 1 wherein said gripping means comprises split ring slip means.

10. Apparatus as defined in claim 1 wherein said path means comprises:

(a) generally annular first passage means communicating with said pressure receiving means; and (b) second passage means, extending generally longitudinally and communicating said first passage means with said open area between said first and second elements.

11. Apparatus as defined in claim 10 wherein said path means further comprises third passage means extending generally radially for communicating between said first and second passage means.

12. Apparatus as defined in claim 1 wherein said gripping means and said pressure receiving means are carried by said second element, said pressure receiving means comprises a generally annular compressible ring means located generally radially outward of said gripping means, and said compressible ring means is compressible generally radially inwardly in response to fluid pressure acting on said pressure receiving means to urge said gripping means generally radially inwardly into said first configuration.

13. Apparatus as defined in claim 12 wherein said gripping means comprises split ring slip means.

14. Apparatus as defined in claim 13 wherein said path means comprises:

(a) generally annular first passage means communicating with said pressure receiving means; and (b) second passage means, extending generally longitudinally and communicating said first passage means with said open area between said first and second elements.

15. Apparatus as defined in claim 14 wherein said path means further comprises third passage means extending generally radially for communicating between said first and second passage means.

16. Apparatus as defined in claim 15 wherein said seal means effects said fluid-sealing between said first and second elements when said first element is in a first longitudinal position relative to said second element, but said fluid-sealing is not effected by said seal means when said first element is in a second longitudinal position relative to said second element.

17. Apparatus as defined in claim 12 wherein said seal means effects said fluid-sealing between said first and second elements when said first element is in a first longitudinal position relative to said second element, but said fluid-sealing is not effected by said seal means when said first element is in a second longitudinal position relative to said second element.

18. Well packer apparatus for use in a well conduit comprising:

(a) a packer body including packer anchoring means, selectively engageable with said well conduit for anchoring said packer body to said well conduit, and packer sealing means, selectively engageable with said well conduit for fluid sealing said packer body to said well conduit, such that said packer apparatus is in a set configuration when said packer anchoring means and said packer sealing means are so anchoring and sealing, respectively, said packer body to said well conduit;

(b) bypass flow passage means for conducting fluids by said packer body in said set configuration;

(c) mandrel means, generally passing through said packer body and selectively moveable longitudinally relative to said set packer body between a first position and a second position;

(d) bypass seal means carried by one of said mandrel means or said packer body, and seat means carried by the other, such that said bypass seal means sealingly engages said seat means when said mandrel means is in said first position, thereby closing said bypass flow passage means to conduction of fluids therethrough, and such that said bypass seal means does not sealingly engage said seat means when said mandrel means is in said second position, thereby rendering said bypass flow passage means open for conducting fluids therethrough; and (e) holding apparatus operable, when said mandrel means is in said first position, in response to fluid pressure on a first side of said bypass seal means in sealing engagement with said seat means, which pressure is tending to move said mandrel means from said first position, including:

(i) gripping means, located longitudinally to the opposite side of said bypass seal means in sealing engagement with said seat means, and moveable between a first configuration in which said gripping means provides anchoring engagement between said mandrel means and said packer body to prevent movement of said mandrel means from said first position, and a second configuration in which said gripping means does not prevent movement of said mandrel means from said first position;

(ii) resilient pressure receiving means operable in response to said fluid pressure acting on said pressure receiving means for propelling said gripping means into said first configuration, and maintaining said gripping means in said first configuration with force which increases as said fluid pressure increases; and (iii) path means for communicating said fluid pressure from said first side of said bypass seal means in sealing engagement with said seat means to said resilient pressure receiving means.

19. Well packer apparatus as defined in claim 18 wherein said holding apparatus is carried by said mandrel means, said gripping means comprises split ring slip means expandable into anchoring engagement with said packer body in said first configuration, said pressure receiving means comprises an annular expandable ring located generally radially within said split ring slip means, and said path means includes a generally annular passage adjacent said annular expandable ring and generally radially therewithin.

20. Well packer apparatus as defined in claim 19 wherein said path means further includes longitudinal passage means extending along said mandrel means for communicating said fluid pressure from said first side of said bypass seal means in sealing engagement with said seat means to said generally annular passage.

21. Well packer apparatus as defined in claim 18 wherein said holding apparatus is carried by said packer body, said gripping means comprises split ring slip means compressible into anchoring engagement with said mandrel means in said first configuration, said pressure receiving means comprises an annular compressible ring located generally radially outside said split ring slip means, and said path means including a generally annular passage adjacent said annular compressible ring and generally radially outwardly thereof.

22. Well packer apparatus as defined in claim 21 wherein said path means further includes longitudinal passage means extending along said packer body for communicating said fluid pressure from said first side of said bypass seal means in sealing engagement with said seat means to said generally annular passage.

23. Well packer apparatus for mounting on a tubing string and for selectively sealing said tubing string to a surrounding conduit comprising:

(a) first seal means for selectively sealing said well packer apparatus to said conduit;

bypass flow passage means for selectively permitting fluid flow between said tubing string and said conduit by said well packer apparatus while said first seal means is so sealing said well packer apparatus to said conduit;

(c) control means, including second seal means, selectively moveable between a first position in which said second seal means closes said bypass flow passage means to said fluid flow, and a second position in which said bypass flow passage means is open to said fluid flow, (d) compensation means operable, with said control means in said first position, in response to fluid pressure differential across said second seal means, which pressure is tending to move said control means from said first position, comprising:

(i) slip means moveable between a first configuration, in which said slip means is disengaged for permitting movement of said control means, and a second configuration, in which said slip means is in anchoring engagement tending to prevent said movement of said control means;

(ii) resilient pressure receiving means for communicating force to said slip means to move said slip means to, and maintain said slip means in, said second configuration in response to said fluid pressure differential to thereby effect said anchoring engagement with force which increases as said pressure differential increases; and (iii) path means for communicating said fluid pressure differential to said pressure receiving means.

* * * * *

UNITED STATES PATENT AND TRADEMARK OFFICE

CERTIFICATE OF CORRECTION

PATENT NO. : 4,078,606

DATED : March 14, 1978

INVENTOR(S) : James W. Montgomery

It is certified that error appears in the above-identified patent and that said Letters Patent are hereby corrected as shown below:

Column 2, line 2, after "19," please delete the number "1" and insert therefor --1977--.

Column 8, line 50, delete the word "procuding" and insert therefor --producing--.

Column 8, line 52, delete the word "annular" and insert therefor --annulus--.

Column 9, line 18, delete the number "98" second occurrence and insert therefor --96--.

Column 9, line 24, delete the number "96" second occurence and insert therefor --98--.

Column 11, line 43, delete the word "wall" and insert therefor --well--.

Column 16, line 30, delete the number "6" second occurrence and insert therefor --5--.

Column 18, line 62, before the word "bypass" insert --b)--.

Signed and Sealed this

Fourteenth Day of November 1978

[SEAL]

Attest:

RUTH C. MASON
Attesting Officer

DONALD W. BANNER
Commissioner of Patents and Trademarks